US007131704B2

(12) United States Patent
Murray et al.

(10) Patent No.: US 7,131,704 B2
(45) Date of Patent: Nov. 7, 2006

(54) SHIFTABLE CONVEYOR FOR ROAD MILLING MACHINE

(75) Inventors: Stuart W. Murray, Brentwood, TN (US); Scott F. Lyons, Lavergne, TN (US)

(73) Assignee: Wirtgen America, Inc., Nashville, TN (US)

( * ) Notice: Subject to any disclaimer, the term of this patent is extended or adjusted under 35 U.S.C. 154(b) by 0 days.

(21) Appl. No.: 10/948,593

(22) Filed: Sep. 23, 2004

(65) Prior Publication Data

US 2006/0061204 A1 Mar. 23, 2006

(51) Int. Cl.
*E01C 23/12* (2006.01)

(52) U.S. Cl. ..... 299/39.2; 198/317

(58) Field of Classification Search ..... 299/39.2; 198/317

See application file for complete search history.

(56) References Cited

U.S. PATENT DOCUMENTS

| | | | | |
|---|---|---|---|---|
| 2,350,579 | A * | 6/1944 | Bingham | 280/446.1 |
| 3,281,162 | A * | 10/1966 | Carson | 280/479.3 |
| 4,560,207 | A | 12/1985 | Eftefield et al. | 299/10 |
| 4,704,045 | A | 11/1987 | Taylor et al. | 404/90 |
| 4,720,207 | A | 1/1988 | Salani | 404/90 |
| 5,178,253 | A * | 1/1993 | Fix | 198/317 |
| 5,219,450 | A | 6/1993 | Thurk | 404/91 |
| 5,441,361 | A * | 8/1995 | Campbell | 404/90 |
| 5,474,397 | A * | 12/1995 | Lyons | 299/39.5 |
| 5,505,598 | A | 4/1996 | Murray | 404/90 |
| 5,582,490 | A | 12/1996 | Murray | 404/90 |
| 6,386,352 | B1 * | 5/2002 | Baker et al. | 198/303 |
| 6,733,086 | B1 | 5/2004 | McSharry et al. | 299/64 |
| 2004/0075330 | A1 * | 4/2004 | Holl et al. | 299/39.2 |

FOREIGN PATENT DOCUMENTS

| | | |
|---|---|---|
| DE | 31 45 713 A 1 | 5/1983 |
| DE | 40 37 448 A 1 | 5/1992 |

OTHER PUBLICATIONS

"Linkage." Encyclopaedia Britannica Online Sep. 15, 2005,<http://www.search.eb.com/eb/article-9048398>.*

Design handbook: Designing 4-bar linkages <http://pergatory.mit.edu/2.007/Resources/machine/linkages/linkage_design.html>.*

* cited by examiner

*Primary Examiner*—John Kreck
(74) *Attorney, Agent, or Firm*—Waddey & Patterson, P.C.; Philiip E. Walker; I. C. Waddey, Jr.

(57) ABSTRACT

A material collection device for particles received from a processing device on a road processing machine. The material collection device comprises a guide having a material discard opening and an attachment face. A conveyor support is shiftably fixed to the guide and is positionable in a substantially horizontal plane with respect to the attachment face. Additionally, the guide is positioned to direct particles milled from the road through the material discard opening to the conveyor support.

29 Claims, 4 Drawing Sheets

SHIFTABLE CONVEYOR FOR ROAD MILLING MACHINE

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

The present invention relates generally to a material collection device for collecting particles from a processing device on a road processing, or milling, machine. More particularly, the present invention relates to an improvement to cold milling machines design for cutting asphalt, concrete and other road surface materials.

The current improvement to such machines enhances the removal of the material cut from the processed surface, or road. More specifically, this invention pertains to a shiftable conveyor used to collect road particles milled from a road surface.

It will be appreciated by those skilled in the art that cold milling machines have existed for many years. Such machines have specially designed milling drums with righted sections protruding in a spiral pattern radially outwardly from the drum. Cutting tool holders are mounted generally on the righted section and cutting tools are fitted within the cutting tool holders. These machines are designed to travel along a road, highway or other thoroughfare and make a continuous cut (for example, 6 feet in width and 12 inches in depth) of the pavement over which they pass. Machines of this type generally fall in the category of road building or material handling equipment.

Known cold milling machines cut the top layer of the road surface material, chop the material into granular form, and rake the material onto a conveyor so that it can be removed from the site. The road can then be paved with new material, keeping the road surface at the desired height and weight.

It is also known in the industry that the width of the milling drums can vary for specific applications of the milling machines. For example, the milling drums can span substantially the entire width of the milling machines or some portion thereof. Currently, the conventional milling machines have a single opening that directs the milled road particles to a removal system, which is normally a conveyor type system. This opening is normally positioned in the middle of the milling machine with flat surfaces, or plates, on opposite sides of the opening to help direct the milled road particles through the opening. Conventionally, this opening does not vary with the width of the milling drum used to mill the road.

The conventional conveying systems are used to transport the milled particles to a secondary processing area or to a collection area, such as a large truck. Conventionally, it is known to vertically vary the height of the exit end of the conveyor systems to match the desired location of the output of the milled road particles.

It is also known to horizontally vary the entry side of the conveyor around a single pivot point, as disclosed in U.S. Pat. No. 5,441,361. This single point rotation of the conveyor belt has several drawbacks. For instance the area with which this single-point-rotation-type conveyor system accepts the road milled particles does not increase and is not repositioned using the single pivot point rotation. This single pivot point rotation of the conveyor is not designed to accept milled road particles from different sized cutting drums or from different locations within the milling machine. This single pivot point rotation conveyor is designed to vary the dispersion at the opposite end of the conveyor. Additionally, this single pivot point rotation conveyor still requires the road milling machine to push the milled road particles through the same opening in order to properly place those road milled particles onto the conveyor regardless of the conveyor's location when it is anchored and rotated about a single center pivot point.

U.S. Pat. Nos. 6,733,086, 5,474,397, 5,219,450, 5,178,253, and 4,560,207 disclose conveyor systems for road milling machines that either do not horizontally vary the location of the conveyor or only rotate the conveyor about a single centrally located pivot point.

As such, what is needed, then, is a horizontally shiftable conveyor system that can be relocated to better align the conveyor entry area to the milling drum of a road milling machine and collect road particles milled by that milling drum. Additionally, what is needed is an opening in the road milling machine that has a cross area that is adjustable to allow the positioning of a shiftable conveyor to better accept milled particles from the drum. The conventional art lacks this horizontally shiftable conveyor system and adjustable opening.

BRIEF SUMMARY OF THE INVENTION

Disclosed herein is a material collection device for particles received from a processing device on a road processing machine. The material collection device comprises a guide having a material discard opening and an attachment face. A conveyor support is shiftably fixed to the guide and is positionable in a substantially horizontal plane with respect to the attachment face. Additionally, the guide is positioned to direct particles milled from the road through the material discard opening to the conveyor support.

In a preferred embodiment the conveyor support is shiftably fixed to the guide by at least one four-bar linkage. Additionally, the conveyor support is moveable between a first position wherein the conveyor support is substantially parallel to the guide and a second position where the conveyor support is substantially oblique to the guide. In the first position the conveyor support is substantially flush to the guide and has one side spaced from the guide while in the second position.

Also, the guide includes a removable section positioned to expand the size of the material discard opening. The removable plate is positioned proximate to the conveyor support when the conveyor support is in the second position.

As such it is an object of the present invention to provide a material collection device shaped to collect particles from a processing device on a road processing machine.

It is another object of the present invention to provide a material collection device having a guide with a material discharge opening that is expandable.

Still yet another object of the present invention is to provide a material collection device including a conveyor support shiftably fixed and movable in a substantial horizontal plane.

Yet still another object of the present invention is to provide a material collection device wherein a conveyor support is shiftably fixed to a guide by at least one four-bar linkage.

And still yet another object of the present invention is to provide a conveyor support in a material collection device wherein the conveyor support is movable between a first position substantially parallel and flush to a guide plate and a second position which is substantially oblique and spaced from the guide plate.

Other and further objects features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

In FIG. 1, the removable section is shown attached to the guide.

In FIG. 2, the removable section is shown displaced from the guide.

DETAILED DESCRIPTION OF THE INVENTION

Figure 1:
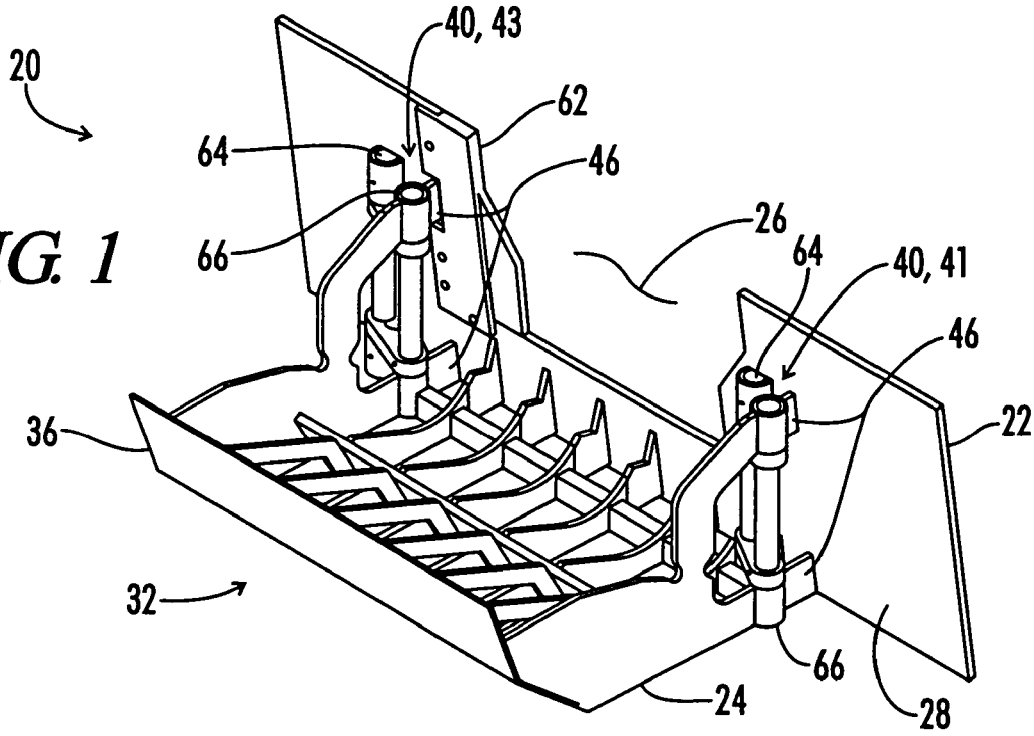
FIG. 1 is a perspective view of the material collection device shown in a first position wherein the conveyor support is substantially parallel to the guide.

Referring generally now to FIGS. 1–7, a road processing machine is schematically shown and generally designated by the numeral 10. The road processing machine (10) generally includes a processing device (12), which can also be described as a milling drum (12), for processing the surface (14) which can be described as a road (14). The road processing machine (10) also includes at least one stanchion (16) used to support a conveyor (18) to transfer the pieces of the surface (14) as the processing device (12) mills pieces of the surface (14).

The shiftable material collection device (20), which can also be described as a shiftable material removal device (20), is a novel invention for a road processing machine (10). The material collection device (20) comprises a guide (22) and a conveyor support (24). The guide (22) includes a material discard opening (26) and an attachment face (28). The conveyor support (24) is shiftably fixed to the guide (22) and is positionable in a substantially horizontal plane with respect to the attachment face (28). Additionally, the guide (22) is positioned to direct particles (30) from the road (14) through the material discard opening (26) to the conveyor support (22) and conveyor (18).

Figure 2:
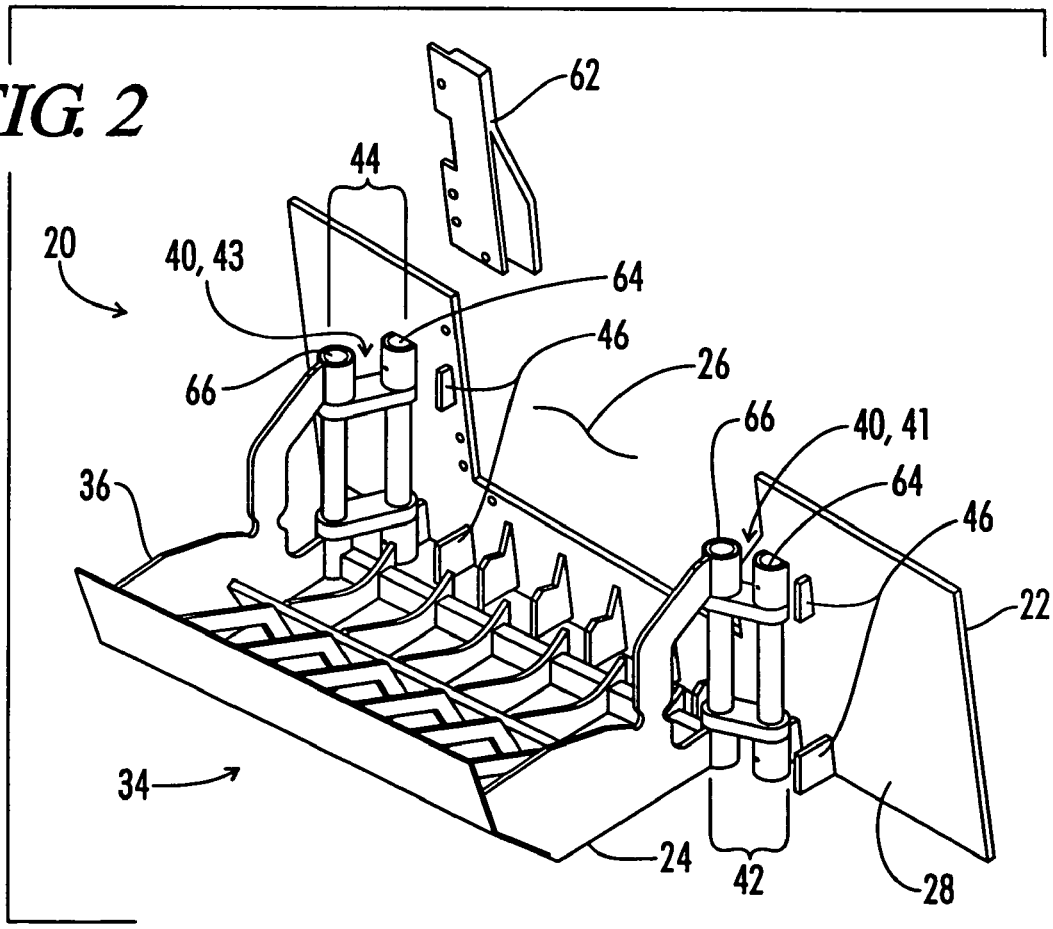
FIG. 2 is a perspective view of the material collection device shown in a second position wherein the conveyor support has been shifted to be into a second position which is oblique to the guide.
Figure 3:
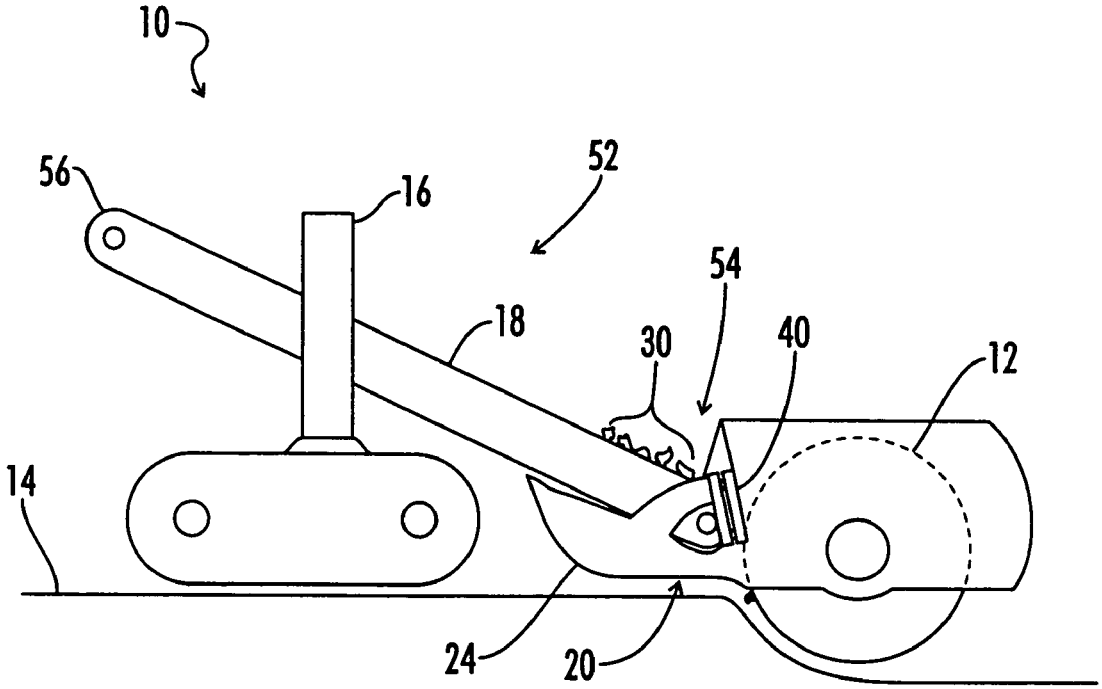
FIG. 3 is a side schematic view of an embodiment of a road processing machine showing an interrelationship between the material collection device and various aspects of the road milling machine.

As seen in FIGS. 1 and 2, the conveyor support (24) is movable between a first position (32) wherein the conveyor support (24) is substantially parallel to the guide (22) and a second position (34) where the conveyor support (24) is substantially oblique to the guide (22). The movement between the first position (32) and second position (34) can be described as a planar positioning of the conveyor support (24) with respect to the guide (22).

In the first position, the conveyor support (24) is substantially flush to the guide (22) while in the second position at least one side (36) of the conveyor support (22) is spaced from the guide (22). Additionally, the first position (22) is substantially horizontally adjacent to the second position (34). When in a second position (34), the conveyor support (24) creates an angle (38) with respect to the attachment face (28) of the guide (22). The angle (38) is preferably approximately five degrees.

In a preferred embodiment, the attachment between the conveyor support (24) and the guide (22) is shiftably fixed by at least one armature (40). A most preferred embodiment includes a first armature (41) and a second armature (43) shiftably fixing the conveyor support (24) to the guide (22). The armatures (40) include four rotatively linked elements positioned to allow a shiftable attachment between the conveyor support (24) and the guide (22). Each armature (40), which can be described as rotational attachments (40), includes a first rotational axis (64) and second rotational axis (66) positioned to shift the conveyor support (24) in a substantially horizontal plane between a first position (32) substantially parallel to the guide (22) and a second position (34) oblique to the guide. Each armature (40) can rotate independently about either rotational axis (64 and 66).

The interaction between the first armature (41), the second armature (43), the conveyor support (24) and the guide (22) can be described as a four bar linkage. Additionally, the first armature (41) extends from the guide (22) a first distance (42) while the second armature (43) extends from the guide (22) a second distance (44). Preferably, the second distance (44) is longer than the first distance of (42), which can facilitate a proper positioning of the conveyor support (24).

As seen in FIGS. 1 and 2, the guide (22) can also include stops (46) positioned on the guide (22) to engage the armatures (40) when the conveyor support (24) is in the first and second positions (32 and 34). The stops (46) can also facilitate a proper positioning of the conveyor support (24).

Figure 4:
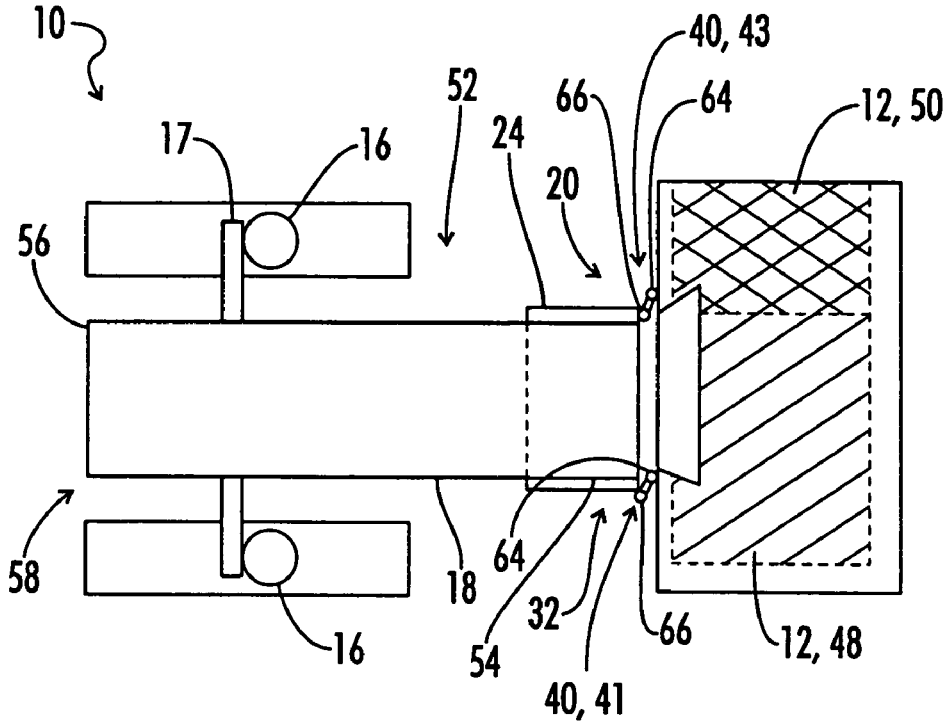
FIG. 4 is a top schematic view of an embodiment of a road processing machine shown with a material collection device in a first position wherein a conveyor support is substantially parallel to a guide.
Figure 5:
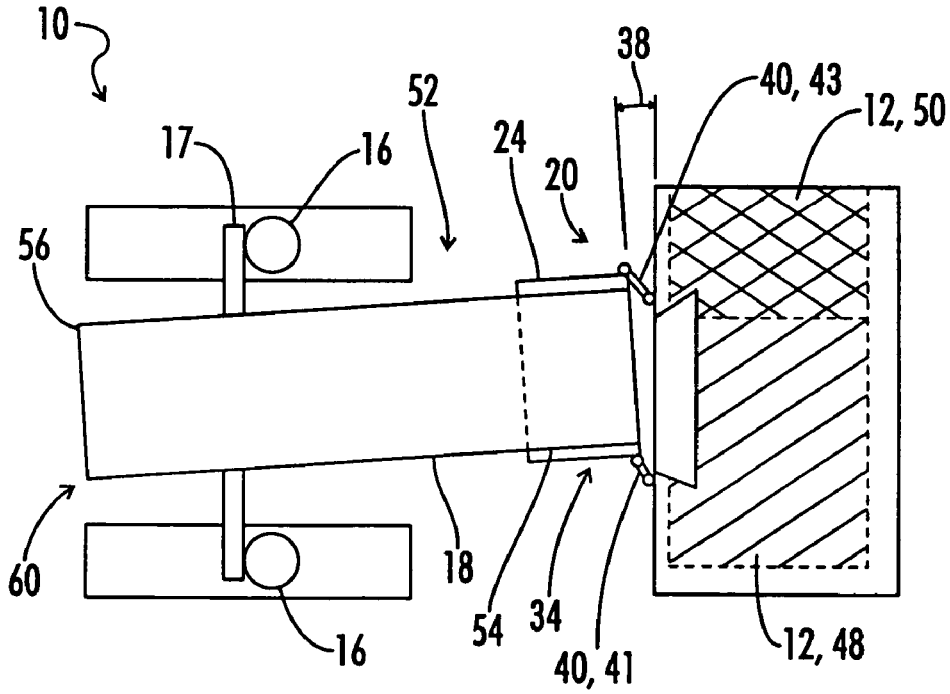
FIG. 5 is a top schematic view of an embodiment of a road processing machine shown with a material collection device in a second position wherein a conveyor support is substantially oblique to a guide.
Figure 6:
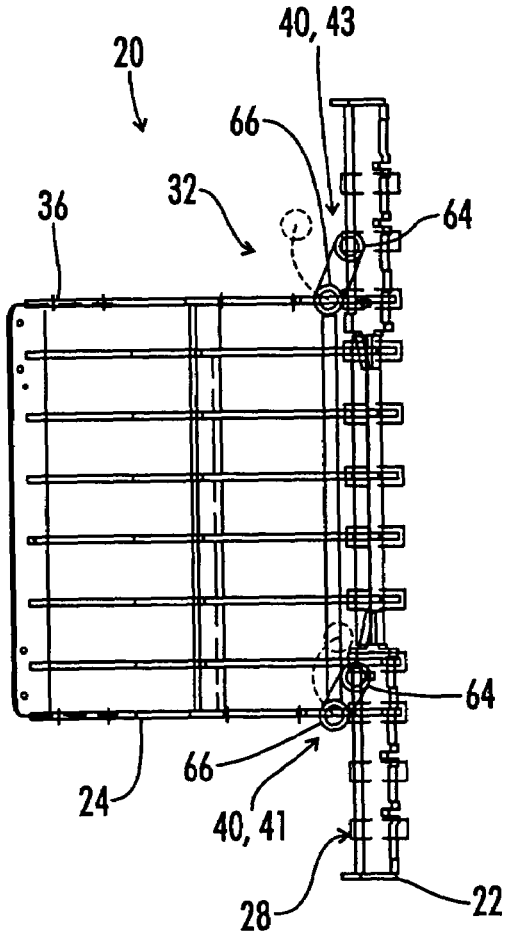
FIG. 6 is a top view of an embodiment of a material collection device shown with a conveyor support substantially flush with the guide.
Figure 7:
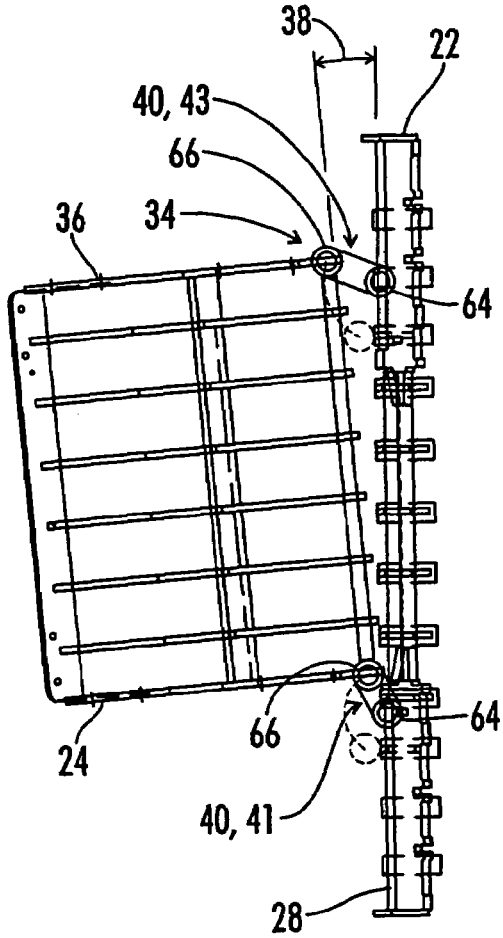
FIG. 7 is a top view of an embodiment of a material collection device shown with a conveyor support in a second position which includes one side spaced from the guide.

The conveyor support (24) is positioned to accept particles (30) from a larger processing device (48), or milling device (48), when in the first position (32) and is positioned to accept particles (30) from a smaller processing device (50), or smaller milling device (50), when in the second position (34). These larger and smaller processing devices (48 and 50) are schematically represented in FIGS. 4 and 5 and can vary in widths as dictated by the specific application and size of the road processing machine (10).

The material removal device (20) also comprises a conveying system (52). The conveying system (52) includes the conveyor (18), the stanchion (16), a first end (54) and a second end (56). The first end (54) is supported by the conveyor support (24) while the stanchion (16) supports the second end (56). The second end (56) is supported by the stanchion (16) and movable in a substantially horizontal plane from a third position (58) to a fourth position (60). The second end (56) is preferably not fixed to stanchions (16), but can slide freely on the support (17) attached to the stanchions (16). The third and fourth positions (58 and 60) preferably maintain the second end (56) between the plurality of stanchions (16) in order to properly discard the particles (30) milled from the road (14).

The guide (22) further includes a removable plate (62), which can also be described as a removable section (62), positioned on the guide (22) to expand the size of the material discard opening (26). Preferably the removable section (62) is positioned proximate to the second position (34) of the conveyor support (24). Additionally, the removable section (62) is positioned to expand the size of the material discard opening (26) as the size of the processing device (12) is reduced. When both armatures (41 and 43) are used, the removable panel (62) is positioned proximate to the second armature (43).

In a preferred embodiment the conveyor support (24) includes a cradle-like shape to support the conveyor (18) in order to properly collect and transport particles (30) away from the milling device (12).

Thus, although there have been described particular embodiments of the present invention of a new and useful Shiftable Conveyor For Road Milling Machine, it is not intended that such references be construed as limitations upon the scope of this invention except as set forth in the following claims.

What is claimed is:

1. A material collection device for particles from a processing device on a road processing machine, the material collection device comprising:

a guide including a material discard opening and an attachment face;

a conveyor support shiftably fixed to the guide and positionable in a substantially horizontal plane with respect to the attachment face; and wherein the guide is positioned to direct particles from the road through the material discard opening to the conveyor support;

wherein the conveyor support is shiftably fixed to the guide by at least one four bar linkage wherein a shift of the conveyor support with respect to the guide horizontally offsets the conveyor support with respect to the guide.

2. The material collection device of claim 1, wherein the four bar linkage comprises the guide, the conveyor support, a first armature, and a second armature.

3. The material collection device of claim 2, wherein each armature is independently rotatable.

4. The material collection device of claim 3, wherein the first armature extends from the guide a first distance and the second armature extends from the guide a second distance, the second distance being longer than the first distance.

5. The material collection device of claim 1, wherein the conveyor support is moveable between a first position wherein the conveyor support is substantially parallel to the guide and a second position wherein the conveyor support is substantially oblique to the guide.

6. The material collection device of claim 5, wherein the conveyor support is substantially flush to the guide in the first position and includes at least one side spaced from the guide in the second position.

7. The material collection device of claim 5, wherein the guide further includes a removable section positioned to expand the size of the material discard opening.

8. The material collection device of claim 7, wherein the removable section is positioned proximate to the second position of the conveyor support.

9. The material collection device of claim 7, wherein the removable section is positioned to expand the size of the material discard opening as the size of the processing device is reduced.

10. The material collection device of claim 5, wherein the conveyor support is positioned to accept particles from a larger processing device in the first position and particles from a smaller processing device in the second position.

11. A material removal device for a road processing machine having a milling device, the material removal device comprising:

a guide positioned proximate to the milling device and including a material discard opening;

a conveyor support;

first and second armatures pivotally fixing the conveyor support to the guide, the first and second armatures positioned to shift the conveyor support in a substantially horizontal plane between a first position substantially parallel to the guide and a second position oblique to the guide wherein the shift of the conveyor support between the first and second positions horizontally offsets the conveyor support with respect to the guide; and wherein the guide is positioned to direct particles from the milling device through the material discard opening to the conveyor support.

12. The material removal device of claim 11, further comprising a conveying system having a first end and a second end, the first end supported by the conveyor support.

13. The material removal device of claim 12, wherein the conveying system further includes a plurality of stanchions operatively supporting the second end.

14. The material removal device of claim 13, wherein the second end is supported by the plurality of stanchions and moveable in a second substantially horizontal plane from a third position to a fourth position.

15. The material removal device of claim 13, wherein the third and fourth positions maintain the second end substantially between the plurality of stanchions.

16. The material removal device of claim 11, wherein the first armature includes a first horizontal length and the second armature including a second horizontal length longer than the first horizontal length.

17. The material removal device of claim 16, wherein the guide further includes a removable panel positioned proximate the second armature.

18. The material removal device of claim 11, wherein the conveyor support is substantially parallel to the guide in the first position and substantially oblique to the guide in the second position.

19. The material removal device of claim 18, wherein the conveyor support intersects the guide at an angle of approximately five degrees in the second position.

20. The material removal device of claim 18, wherein the second position is substantially horizontally adjacent to the first position.

21. The material removal device of claim 11, wherein the guide further includes a removable panel positioned proximate the second position and shaped to increase the size of the material discard opening.

22. The material removal device of claim 21, wherein the removable panel is positioned to expand the size of the material discard opening as the size of the milling device is reduced.

23. The material removal device of claim 22, wherein the conveyor support is positioned to accept particles from a larger milling device in the first position and particles from a smaller milling device in the second position.

24. A material removal device for a road processing machine having a milling device, the material removal device comprising:

a guide positioned proximate to the milling device and including a material discard opening;

a conveyor support;

first and second armatures pivotally fixing the conveyor support to the guide, each armature including a first rotational axis and second rotational axis positioned to shift the conveyor support in a substantially horizontal plane between a first position substantially parallel to the guide and a second position oblique to the guide;

wherein the guide is positioned to direct particles from the milling device through the material discard opening to the conveyor support; and wherein the shift of the conveyor support between the first and second positions horizontally offsets the conveyor support with respect to the guide.

25. A material removal device for a road processing machine having a milling device, the material removal device comprising:

a guide positioned proximate to the milling device and including a material discard opening;

a conveyor support fixed to the guide by at least two rotational attachments, wherein the conveyor support is positionable in a substantially horizontal plane between a first position substantially parallel to the guide and a second position oblique to the guide; and wherein the shift of the conveyor support between the first and second positions horizontally offsets the conveyor support with respect to the guide.

26. The material removal device of claim 25, wherein each rotational attachment includes a first rotational axis and second rotational axis positioned to independently shift the conveyor support.

27. The material collection device of claim 1, wherein the conveyor support shifts with respect to the guide about multiple points.

28. The material collection device of claim 1, wherein the conveyor support shifts with respect to the guide with out rotating about a single point.

29. The material collection device of claim 1, wherein:

the conveyor support includes a center;

the guide includes a center; and the shift of the conveyor support with respect to the guide horizontally offsets the center of the conveyor support with respect to the center of the guide.

* * * * *